US005158175A

United States Patent [19]

Crawford

[11] Patent Number: 5,158,175

[45] Date of Patent: Oct. 27, 1992

[54] SPORTS CARD SORTER BOX/TRAY COMBINATION AND CARD SORTING METHOD

[76] Inventor: Laren F. Crawford, 3318 Viewpoint Dr., Medford, Oreg. 97504

[21] Appl. No.: 680,504

[22] Filed: Apr. 4, 1991

[51] Int. Cl.[5] ..... B65D 5/32

[52] U.S. Cl. ..... 206/45.11; 206/449; 206/455; 206/579; 229/120.09

[58] Field of Search ..... 206/44 B, 44.12, 45.11, 206/45.12, 45.15, 425, 449, 455, 579; 229/103, 117.14, 117.15, 120.03, 120.09, 120.18, 120.24, 198.1, 198.3

[56] References Cited

U.S. PATENT DOCUMENTS

| | | | |
|---|---|---|---|
| 789,782 | 5/1905 | Yates | 206/45.11 |
| 1,016,148 | 1/1912 | Heinicke | 206/45.11 |
| 2,983,372 | 5/1961 | Amatel et al. | 206/45.12 |
| 3,835,987 | 9/1974 | Growney | 206/45.11 |
| 4,267,959 | 5/1981 | Gilbert | 229/117.14 |

FOREIGN PATENT DOCUMENTS

| | | | |
|---|---|---|---|
| 0921416 | 3/1963 | United Kingdom | 206/45.11 |

*Primary Examiner*—Jimmy G. Foster

*Attorney, Agent, or Firm*—Philip Junkins

[57] ABSTRACT

A sports card sorter box/tray combination unit and card sorting method. The card sorter box/tray unit includes two mating half-sections which each include five card sorting bins. The sorting bins in the first half-section are numbered in sequence from 0 to 4 and the sorting bins of the second half-section are numbered in sequence from 5 to 9. With the tray-box unit in open and card sorting position the half-sections of the unit are aligned in substantially end-to-end orientation with the bins aligned in numbered sequence from 0 to 9. The card sorting bins of each half-section of the tray-box unit are open on their upper and inner sides so that sports cards can be easily slipped into the numbered bins. The half-sections of the tray-box unit each bear an upper cover and handle portion which cooperate together, when the unit is closed for card carrying and storage purposes, to close the upper sides of the sorting bins and maintain the enclosed sports cards in stored position therein. Utilizing the sports card sorting tray and card carrying and storage box unit in its card sorting operative position, a method of card sorting is practiced which yields the collection of sports cards in numbered sequence.

4 Claims, 2 Drawing Sheets

SPORTS CARD SORTER BOX/TRAY COMBINATION AND CARD SORTING METHOD

FIELD OF THE INVENTION

The present invention relates to the collection, sorting and storage of sports cards of the type displaying the picture of, and historical data and information respecting, current and past sports athletes, officials and personalities who are participating (or have participated) in the major amateur and professional sports field including (but not limited to) baseball, football, basketball, swimming, track, and tennis.

BACKGROUND OF THE INVENTION

The collection of sports cards, particularly by sports minded individuals, has become a major hobby or avocation throughout the United States and elsewhere in the world. The typical collectable sport card comprises a 2½ inch by 3½ inch cardboard or paperboard piece upon which on the face side is printed the picture of a sport athlete, official or personality and which bears on the rear side a card number and historical data and information about the person including: name and nickname, date and place of birth, career team history, playing statistics, honors, and other pertinent information. Not only has the collection of sports cards become a major hobby, but the manufacture, marketing and trading of such cards has developed into significant high-volume business activities. Further, the individuals (collectors and traders) and the businesses involved in the sports card field have organized clubs, publications, exhibitions and conventions to further the interests of the field and to entice others to participate. The complexities of sports card collecting and trading and the handling and storage of literally thousands of cards by collectors and traders have resulted in the need for unique and functional card collection, sorting and storing apparatus and for methods of accomplishing such functions.

OBJECTS OF THE INVENTION

It is therefore a principal object of the present invention to provide a combination sports card sorter tray and storage box for use by sports card collectors and traders.

It is still another object of the invention to provide a sports card sorter tray and storage box combination which may be easily assembled by a user.

It is a further object of the invention to provide a sports card sorter tray, with sequential sorting compartments, through which 1000 or more numbered sports cards can be sorted and arranged by number in a minimum of time.

It is a still further object of the invention to provide a method through which 1000 or more numbered sports cards can be sorted and arranged by number with little tedious effort in a minimum of time.

Other objects, features and advantages of the present invention will be apparent from the following summary and detailed description of the invention, taken in conjunction with the accompanying drawing figures.

SUMMARY OF THE INVENTION

The present invention relates to a combination sports card sorter tray and storage box which is fabricated by the user from cardboard, pasteboard or sheet plastic cut-out pieces having appropriate fold lines and accompanying fabrication directions. The tray-box combination is formed in two half-sections which each include five sorting bins. The sorting bins in the first half-section are numbered in sequence from 0 to 4 and the sorting bins of the second half-section are numbered in sequence 5 to 9. With the tray-box unit in open and card sorting position the half-sections of the unit, which may be hinged to one-another, are aligned in substantially end-to-end orientation with the bins aligned in numbered sequence from 0 to 9.

The card sorting bins of each half-section of the tray-box unit of the invention are open on their upper and inner sides so that sports cards can be easily slipped into a numbered bin during the card sorting operation. The half-sections of the tray-box unit are designed and fabricated from their respective cut-out board pieces so that each bin has a floor which slopes downwardly from the open inner side of the half-section to the closed rear side thereof. Thus, cards that are placed in the bins during the card sorting operation, and cards which are later stored in bins in sorted order, are stacked within each bin in a slightly tilted rearward fashion such that they will not readily or easily slip out of the bins.

The half-sections or the tray-box unit (as fabricated) each bear an upper cover and handle portion which cooperate together, when the unit is closed for card carrying and storage purposes, to close the upper sides of the sorting bins and maintain the enclosed sports cards in sorted position therein. End pieces, also fabricated from cut-out pieces of cardboard, pasteboard or sheet plastic material, may be applied to the ends of the half-sections of the tray-box unit to maintain the sections in closed position. When the tray-box half-sections are in their closed position, with the end pieces applied, the card sorting bins of each half-section are closed with respect to their otherwise open inner sides by the opposing half-section of the tray-box unit. In the closed position of the tray-box combination, the handle portion of each half-section mates with the handle portion of the other half-section for box carrying purposes. When the tray-box combination is in its open operative card sorting position the cover and handle portion of each half-section extends upwardly and away from the open bins of the half-section.

Utilizing the sports card sorting tray and box combination of the invention in its card sorting operative position, card sorting according to the method of the invention is accomplished by first placing numbered sports cards from a mixed collection of cards in numbered bins according to the last digit of the card number. The cards from each bin are then withdrawn (as a bin stack of cards) starting with bin 9 and piled in sequence with the cards in the stack from bin number 0 ending up on top of the pile of cards. Next the cards from the pile are placed in the numbered bins according to the second last digit of the card number (Note that cards with only one digit in their number go into the bin marked 0). The cards from each bin are then withdrawn (as a bin stack of cards) starting with bin 0 and piled in sequence with the cards in the stack from bin number 9 ending up on top of the new pile of cards. Finally, the cards from the new pile are placed in the numbered bins according to the third last digit of the card number (Note that cards with numbers less than 100 go into the bin marked 0). Through this card sorting method sports cards having numbers ranging from 1 to 999 are sorted in numerical order starting with bin 0 which contains all cards with numbers from 1 to 99. The method of card sorting for card collections having more than 1000 cards is altered by sorting by 100's placing cards numbered from 1 to 99 in the bin marked 0 during a first sort sequence. Thereafter, the cards of each 100's group are sorted as first described above.

BRIEF DESCRIPTION OF THE DRAWING FIGURES

The above and other features and advantages of the invention are illustrated in the accompanying drawing figures in which.

Figure 5:
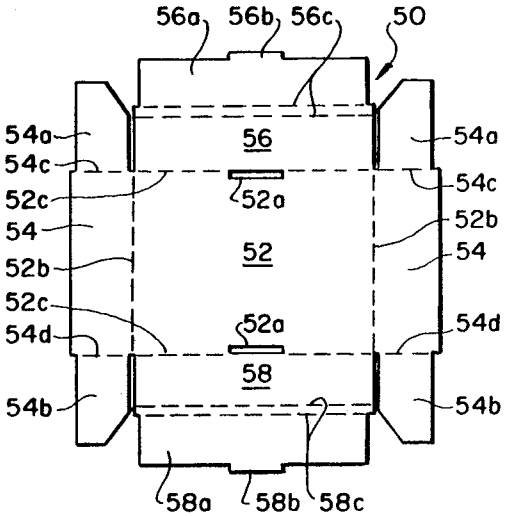
Figure 4:
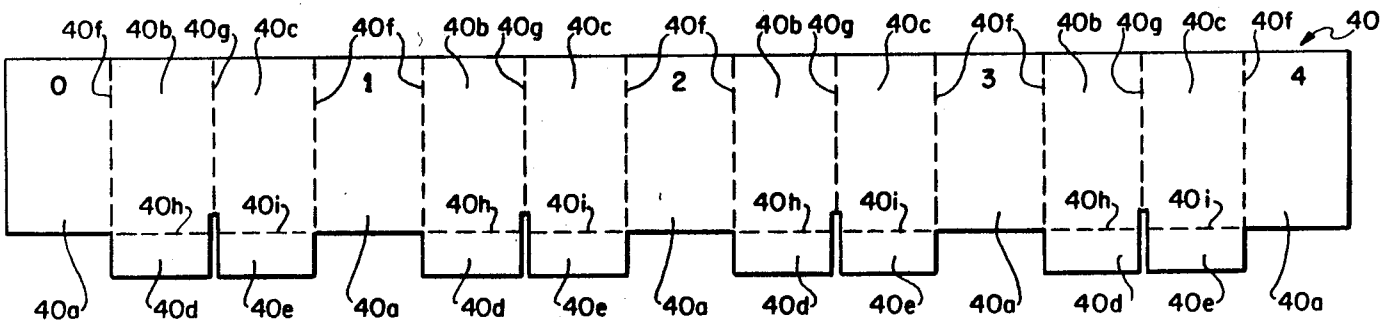

FIG. 4 is a top plan view of the cardboard, pasteboard or sheet plastic cut-out piece which, when folded up and interlocked within the main body piece of a half-section of the tray-box unit, forms the bin divider walls of each half-section of the unit; and FIG. 5 is a top plan view of the cardboard, pasteboard or sheet plastic cut-out piece which, when folded up, forms and end piece for the tray-box unit of the invention to maintain the unit in closed card storage and carrying orientation.

DETAILED DESCRIPTION OF THE INVENTION

Figure 1:
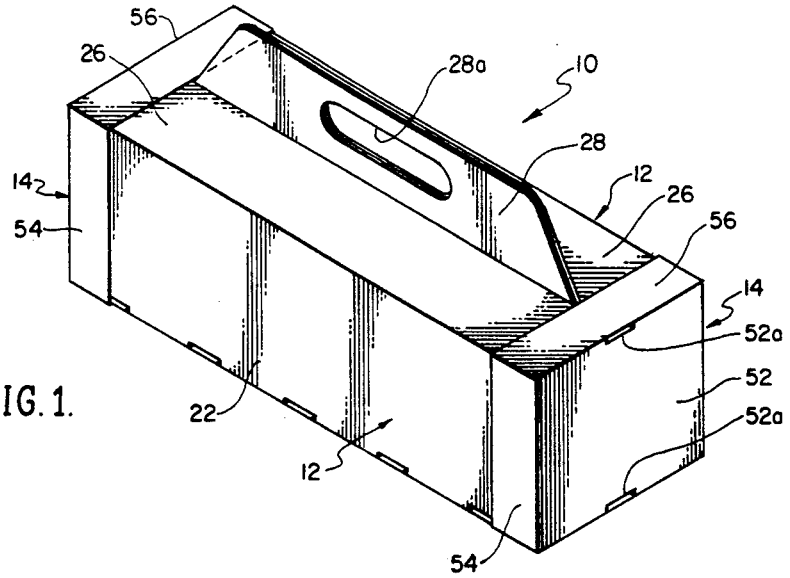
FIG. 1 is an isometric view of the combination sports card sorter tray and storage box of the invention in its closed orientation for card storage and carrying purposes.
Figure 3:
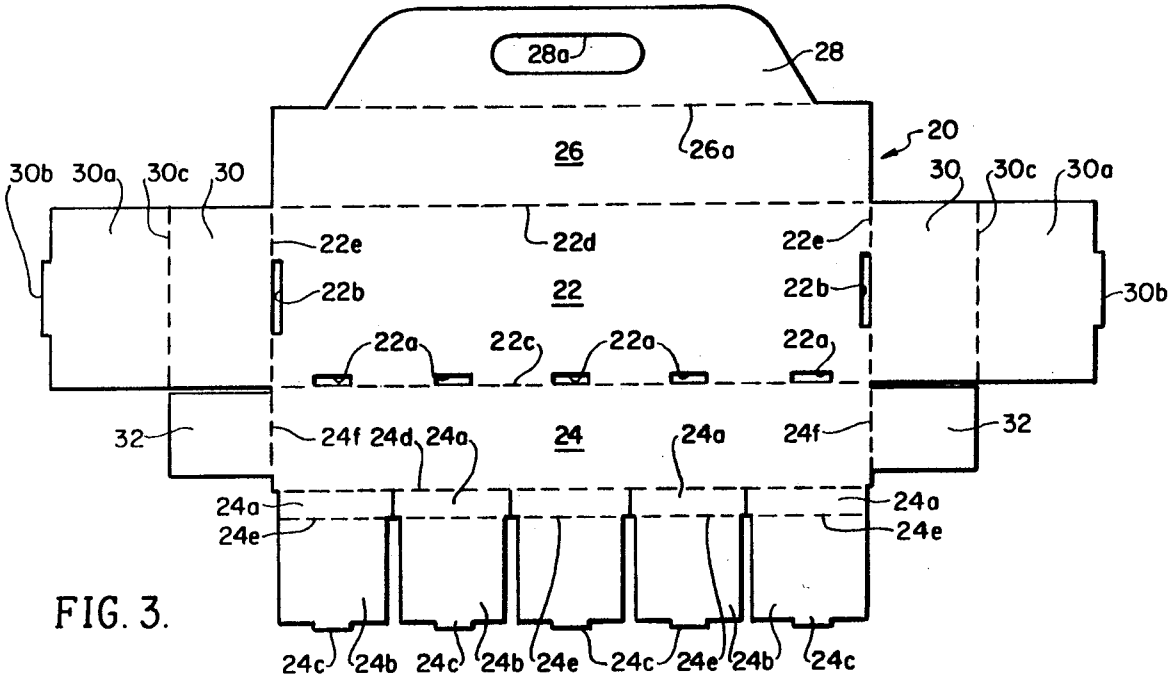
FIG. 3 is a top plan view of the cardboard, pasteboard or sheet plastic cut-out piece which, when folded up, forms the main body of a half-section of the tray-box unit of the invention.

A preferred embodiment of the sports card sorter tray and storage box combination or unit of the present invention is shown in FIG. 1 in an isometric view and in its closed orientation for card storage and carrying purposes. The tray-box unit, generally indicated by the numeral 10, has as its principal structural components two card sorting half-sections 12 and two end pieces or cap-type closure members 14 which maintain the half-sections in a closed and abutting arrangement. The half-sections 12, as shown in FIG. 1, are each fabricated from a cardboard, pasteboard or sheet plastic cut-out piece 20 (see FIG. 3) having appropriate fold lines. The cut-out piece 20 for each half-section 12 includes an outer side wall portion 22, a bottom wall portion 24 (not visible in FIG. 1), and a top wall portion 26 which terminates in an up-standing handle portion 28. The two card sorting half-sections 12, each include internally a sorting bin divider structure 16 (not shown in FIG. 1). The bin divider structure 14 for each half-section 12 of the tray-box unity 10 is also fabricated from a cardboard, pasteboard or sheet plastic cut-out piece 40 (See FIG. 4). The two end pieces 14 likewise are each fabricated from a cardboard, pasteboard or sheet plastic cut-out piece 50 having appropriate fold lines. The cut out pieces 20, 40 and 50 of these structural components of the tray-box unit 10 are shown in top plan view in FIGS. 3, 4 and 5, respectively, of the drawing sheets.

Figure 2:
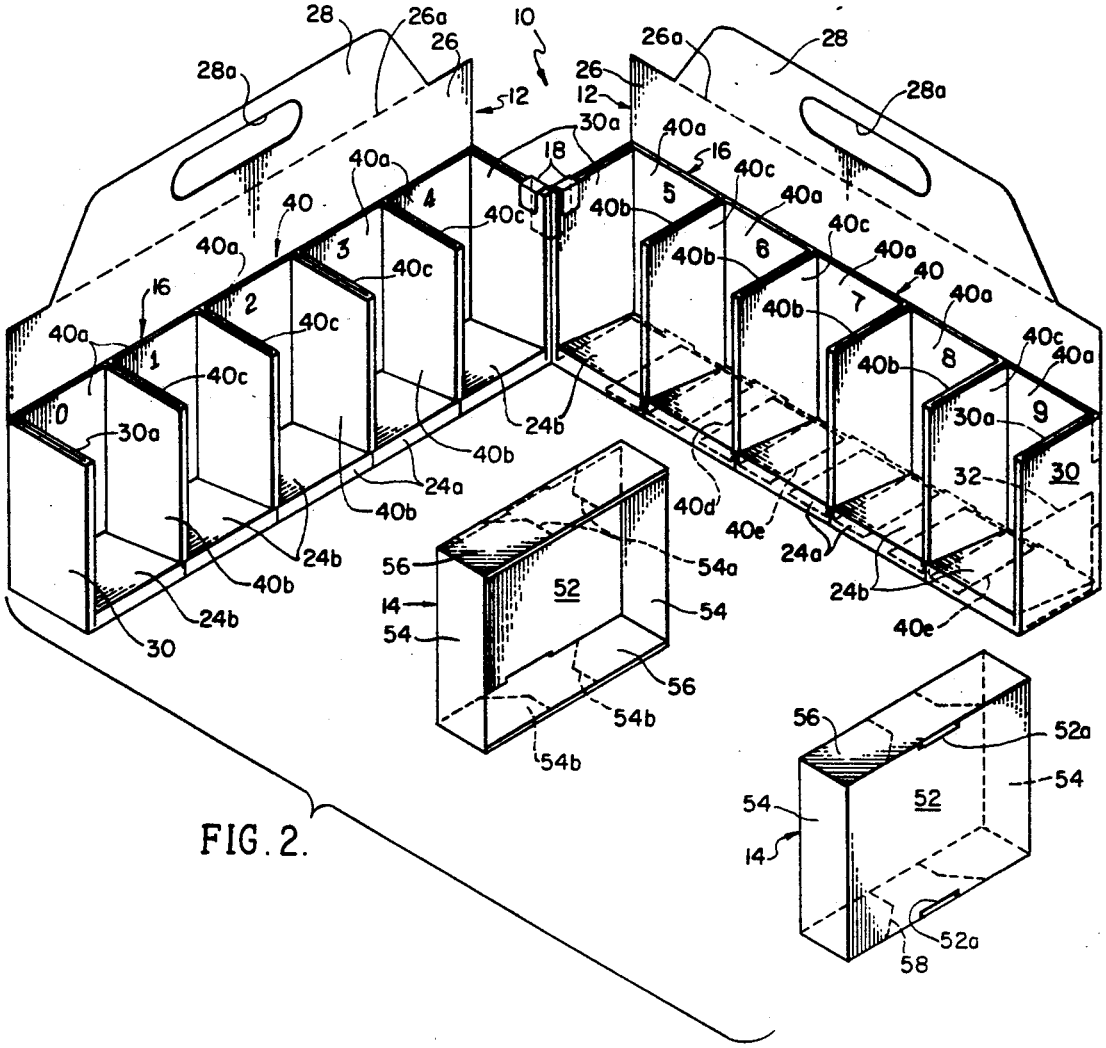
FIG. 2 is an isometric view of the card sorter tray and storage box combination, in partially opened orientation, showing the two half-sections of the unit in hinged connection and with the ten card sorting bins in 0 to 9 numbered sequence, and showing the end pieces removed from the tray-box unit.

FIG. 2 is an isometric view of the card sorter and storage box unit 10, in partially opened orientation, showing the two half-sections 12 of the unit in hinged connection and with ten card sorting bins in 0 to 9 numbered sequence defined by the internal bin divider structures 16 in each half-section. In such figure the two like end pieces 14 are shown as separated from the card sorter structure. The card sorter half-sections 12 may be hinged together via a clip-on hinge arrangement 18 of known design. When the tray-box unit 10 is in its fully opened card sorting position the half-sections 12 of the unit are positioned in substantially end-to-end orientation with ten numbered bins aligned in the numbered sequence of 0 to 9.

As clearly shown in FIG. 2, the card sorting bins (numbered 0 to 9) of each half-section 12 of the tray-box unit 10 are open on their upper and inner sides so that sports cards can be easily slipped into an appropriate bin during the card sorting procedure. As previously indicated, the like half-sections 12 of the tray-box unit are designed and fabricated from cut-out board pieces 20 (See FIG. 3) and each half-section 12 includes a sorting bin divider structure 16 designed and fabricated from a cut-out board piece 40 (See FIG. 4). The cut-out board piece 20 includes a rectangular side wall portion 22 and contiguous bottom wall portion 24, top wall portion 26 (with its extended handle portion 28), and end wall portions 30. The wall portion 22 includes lower assembly slots 22*a* and end assembly slots 22*b*, the function of which will be described hereinafter. The contiguous bottom, top and end wall portions 24, 26 and 30 join the rectangular side wall portion of each half-section 12 of the tray-box unit 10 at fold lines 22*c*, 22*d* and 22*e*, respectively. These fold lines, as well as other fold lines of the cut-out boards 20, 40 and 50 may be scored so that the assembly operations for fabricating the tray-box unit 10 can be more easily accomplished.

The bottom wall portions 24 of the like cut-out board pieces 20 have an extended longitudinal portion 24*a* which forms the lower facing for each half-section 12 of the tray-box unit 10 of the invention. The longitudinal portion 24*a* of each cut-out board 20 has five extended portions 24*b* which form the equally spaced floor portions of the half-section of the tray-box unit and such five extended floor portions 24*b* each bear an assembly tab 24*c*. The longitudinal facing portion 24*a* joins the bottom wall portion of cut-out board 20 along fold line 24*d* and the five extended floor portions 24*b* join the longitudinal facing portion 24*a* along fold lines 24*e*. The bottom wall portions 24 of cut-out boards 20 also include extended end flaps 32 which join the bottom wall potions along fold lines 24*f*. The end wall portions 30 of the like cut-out board pieces 20 each have an extended assembly flap portion 30*a* which bears an assembly tab 30*b* and each assembly flap portion joins its respective end wall portion along fold line 30*c*.

The sorting bin divider structure 16 of each half section of the tray-box unit 10 of the invention, as previously indicated, is formed from the cut-out board piece 40 designed as illustrated in FIG. 4. The board piece 40 is comprised of a series of panels which are each defined by fold lines. Thus, the board piece 40 includes a series of back panels 40*a* for the bin divider structure 16 which are separated by pairs of bin wall panels 40*b* and 40*c*. Each bin wall panel 40*b* and 40*c* bears an extended foot portion 40*d* and 40*e*, respectively. The back panels 40*a* join their contiguous bin wall panels along fold lines 40*f* and the bin wall panels 40*b* and 40*c* join each other along a fold line 40*g*. The extended foot portions 40*d* and 40*e* of bin wall panels 40*b* and 40*c* join their respective panels along fold lines 40*h* and 40*i*.

To assemble the card sorting half-sections 12 of the sorter tray and storage box unit 10 of the invention, the end flaps 32 (which extend from bottom portion 24 of cut-out board 20) are folded upwardly along fold line 24*f* and the bottom portion 24 is then folded upwardly along fold line 24*d* with the edges of flaps 32 thereby touching the side wall portion 22 along fold lines 22*e*. Thereafter, the end wall portions 30 of cut-out board 20 are folded upwardly along fold lines 22*e* (outside of the flaps 32) and the extended assembly flap portion 30*a* of each end wall is folded inwardly and downwardly along fold line 30*c* so that flaps 32 are encompassed by end wall 30 and the assembly flap portion 30*a* thereof. The assembly tab 30*b* at the edge of flap portion 30*a* of each end wall 30 is pushed into its mating end assembly slot 22*b* of the side wall 22 to lock the end walls 30 and the bottom wall 24 into their respective assembled positions.

To assemble the interior bin divider structure 16 for each card sorting half-section 12, the extended foot portions 40*d* and 40*e* of bin wall panels 40*b* and 40*c*, respectively, of the cut-out board piece 40 are folded upwardly along fold lines 40*h* and 40*i*. Thereafter, the pairs of bin wall panels 40*b* and 40*c* are folded together (back-to-back) along fold line 40*g* with the folded foot portions 40*d* and 40*e* extending outwardly from each other. The interior bin divider structure 16 is inserted into a card sorting half-section 12 with the rear sides of the back panels 40*a* (between the folded pairs of bin wall panels 40*b* and 40*c*) interfacing with the inside surface of the rectangular side wall portion 22 of the half-section 12 and the extended foot portions 40*d* and 40*e* of the bin wall panels 40*b* and 40*c* interfacing with the bottom wall portion 24 of the half-section 12. The position of the extended foot portions 40*d* and 40*e* in interface with the bottom wall portion 24 of the half-section 12 is shown by dashed outline in FIG. 2 for bins 5 to 9. Next, the extended longitudinal portions 24*a* (of the bottom portion 24) with their respective extended bin floor portions 24*b* are folded upwardly along fold lines 24*d* and such floor portions are then folded rearwardly (and downwardly) along fold lines 24*e* to the back panels 40*a* of the interior bin divider structure 16. Finally, the assembly tabs 24*c* borne by each of the bin floor portions 24*b* are inserted into the assembly slots 22*a* at the bottom of the side wall portion 22 whereby the interior bin divider structure 16 is locked into the card sorting half-section 12 of the tray-box unit 10. Because of the extended longitudinal portions 24*a* of the bottom portions 22 of the half-sections 12, the floor portions 24*b* (when folded back into the card sorting bins with their tabs 24*c* inserted into slots 22*a*), have a slight downward slope from the open inner side of the half-section to the closed rear side of each bin. This downward slope of the floor portions 24 is clearly shown in FIG. 2 with respect to bins 5 to 9. Thus, sports cards that are placed in the bins during the card sorting operation, and cards which are later stored in the bins in sorted order, are oriented within each bin in a slightly tilted rearward fashion such that they will not readily or easily slip out of the bins.

As previously indicated, the two end pieces or cap-type closure members 14, which maintain the card sorting half-sections 12 in a closed and abutting arrangement during periods of card storage or transport, are each fabricated from a board cut-out piece 50 which is shown in top plan view in FIG. 5. The cut-out board piece 50 includes a rectangular end or closure wall portion 52 and contiguous side wall portions 54 and contiguous like top and bottom wall portions 56 and 58, respectively. The end wall portion 52 includes upper and lower assembly slots 52*a*, the function of which will be described hereinafter. The contiguous side wall portions 54 and top and bottom wall portions 56 and 58 of each closure member 14 join the rectangular closure wall portion 52 at fold lines 52*b* and 52*c*, respectively. The top and bottom wall portions 56 and 58 have an extended longitudinal portion 56*a* and 58*a*, respectively, and each such extended portion bears an assembly tab 56*b* and 58*b*, respectively. The extended longitudinal portions 56*a* and 58*a* join their respective wall portions 56 and 58 along double fold lines 56*c* and 58*c*. The side wall portions 54 each have extended assembly flaps 54*a* and 54*b* which join their respective side wall portions along fold lines 54*c* and 54*d*.

To assemble the cap-type closure members 14 of the card sorter tray and storage box unit 10 of the invention, the assembly flaps 54*a* and 54*b* (which extend from the side wall portions 54 of cut-out board 50) are folded upwardly along fold lines 54*c* and 54*d*, respectively, and the side wall portions 54 are then folded inwardly along fold lines 52*b* with the edges of flaps 54*a* and 54*b* thereby touching the rectangular closure wall 52 along fold lines 52*c*. Thereafter, the top and bottom wall portions 56 and 58 of the cut-out board 50 are folded upwardly along fold lines 52*c* (outside of the flaps 54*a* and 54*b*) and the extended longitudinal portions 56*a* and 58*a* of the top and bottom wall portions 56 and 58, respectively, are then folded inwardly and thence downwardly along the double fold lines 56*c* and 58*c* so that the flaps 54*a* and 54*b* are encompassed by the top and bottom wall portions 56 and 58 and their respective extended portions 56*a* and 58*a*. The assembly tabs 56*b* and 58*b* borne by extended portions 56*a* and 58*a*, respectively, are inserted into the assembly slots 52*a* of closure wall portion 52 to lock the side walls 54, and the top and bottom walls 56 and 58 into their ultimate positions to form the cap-type closure 14 of the invention.

When the card sorting tray-box unit 10 of the invention is in its open operative card sorting position the cover and handle portions 26 and 28 of each half-section of the unit extends upwardly and away from the open bins thereof. As previously indicated, the half-sections 12 of the unit may be hinged (in known manner) so that the half-sections may be positioned end-to-end with the ten card sorting bins of the entire unit aligned in numerical order from 0 to 9.

Utilizing the sports card sorting tray and storage box combination 10 in its card sorting operative position, card sorting according to the method of the invention is accomplished by first placing numbered sports cards from a mixed stack or collection of cards in the numbered bins according to the last digit of the card number. Thus, a card bearing the number 3 would be placed in bin number 3, a card bearing the number 72 would be placed in bin number 2, a card bearing the number 100 would be placed in bin number 0, and a card bearing number 375 would be placed in bin number 5. The cards from each bin are then withdrawn (as a bin stack of cards) starting with bin 9 and piled in sequence with the cards in the stack from bin number 0 ending up on top of the re-piled cards. Next the cards from the pile are placed in the numbered bins according to the second last digit of the card number (Note that for the next round of sorting cards with only one digit in their number now go into go into the bin marked 0). Thus, the card bearing the number 3 is placed in the bin numbered 0, the card bearing the number 72 is placed in the bin numbered 7, the card bearing the number 100 is placed in the bin numbered 0, and the card numbered 375 is placed in the bin numbered 7.

The cards from each bin are again withdrawn (as a bin stack of cards) starting with bin 0 and piled in sequence with the cards in the stack from bin number 9 ending up on top of the new pile of cards. Finally, the cards from the new pile are placed in the numbered bins according to the third last digit of the card number (Note that with the next round of sorting cards with numbers less than 100 go into the bin marked 0). Thus, the cards numbered 3 and 72 are placed in the bin numbered 0, the cards numbered 100 is placed in bin numbered 1 and the card numbered 375 is placed in bin numbered 3. Through this card sorting method sports cards having numbers ranging from 1 to 999 are sorted by 100's in numerical order starting with bin 0 which contains all cards with numbers from 1 to 99. The method of card sorting for card collections having more than 1000 cards is altered by sorting by 100's placing cards numbered 1 to 99 in the bin marked 0 during a first sorting sequence. Thereafter, the cards of each 100's group are sorted as first described above.

While the invention has been described in connection with a particular structural form embodiment of a sports card sorter box/tray combination and example of the card sorting method which may be practiced utilizing the disclosed box/tray combination, many modifications of the apparatus and method will be apparent to those skilled in the art. Accordingly, such modifications are to be included within the spirit and scope of the invention as defined by the following claims.

what I claim is:

1. A portable combination sports card sorting tray and card carrying and storage box comprising:

a) a pair of card sorting tray sections each fabricated from an initially flat cut-out board piece having wall defining fold lines and formed so as to include an outside wall, a bottom wall and end walls;

b) hinge means connecting said pair of tray sections whereby during card sorting operations said tray sections may be positioned end-to-end to form a card sorting tray assembly;

c) a sorting bin divider unit for each of said tray sections, each of said bin divider units being fabricated from an elongated and initially flat cut-out board piece having divider wall panels and separator back panels defined by fold lines and formed for insertion into a tray section with the separator back panels interfacing the outside wall of said tray section and the divider wall panels extending vertically from the bottom wall of said tray section and forwardly from said back panels at spaced intervals along the length of said tray section to form five card sorting bins therein whereby when said tray sections are positioned end-to-end during card sorting operations said card sorting tray assembly has ten aligned card sorting bins, the bottom wall of each tray section including five extended portions folded back to the lower edge of the outside wall of said tray section in a downwardly sloping orientation between the divider wall panels of the sorting bin divider unit within said tray section to provide a sloping floor within each bin whereby cards placed within the bins are stacked in a slightly tilted rearward fashion such that they will not slip out of said bins; and d) closure means for said tray sections whereby during card storage and carrying operations said tray sections are secured together with the inside of said tray sections mating in fact-to-face alignment to close said bins.

2. A portable combination sports card sorting tray and card carrying and storage box as claimed in claim 1 wherein the outside wall of each tray section includes an extended upper foldable portion which together form a cover and handle for said combination tray and box when said tray sections are secured together with said bins in face-to-face closed alignment.

3. A portable combination sports card sorting tray and card carrying and storage box as claimed in claim 1 wherein the card sorting sections and the sorting bin divider unit for each of said sorting sections are fabricated from pieces of flat cut-out board selected from the group consisting of cardboard, pasteboard and sheet plastic materials.

4. A portable combination sports card sorting tray and card carrying and storage box as claimed in claim 1 wherein the closure means for said tray sections for securing said sections in mating face-to-face alignment to close said bins comprises end caps which removably encompass the ends of said tray sections.

* * * * *